US008330392B2

(12) United States Patent
Zulch

(10) Patent No.: US 8,330,392 B2
(45) **Date of Patent: *Dec. 11, 2012**

(54) INTENSITY CHANGING WITH REDUCED FLICKER FOR DIGITALLY-CONTROLLED LIGHTING

(75) Inventor: Richard C. Zulch, Orinda, CA (US)

(73) Assignee: Zulch Laboratories, Inc., Orinda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/160,708

(22) Filed: Jun. 15, 2011

(65) Prior Publication Data

US 2011/0234119 A1 Sep. 29, 2011

Related U.S. Application Data

(63) Continuation of application No. 11/809,364, filed on May 31, 2007, now Pat. No. 7,994,732.

(60) Provisional application No. 60/856,560, filed on Nov. 3, 2006.

(51) Int. Cl.
*G05F 1/00* (2006.01)

(52) U.S. Cl. ..... 315/307; 315/291

(58) Field of Classification Search ..... 315/291, 315/307; 345/204, 690, 691, 53
See application file for complete search history.

(56) References Cited

U.S. PATENT DOCUMENTS 5,561,351 A * 10/1996 Vrionis et al. ..... 315/248
7,049,752 B2 5/2006 Tani et al.
7,529,594 B2 * 5/2009 Walters et al. ..... 700/17
7,663,325 B2 * 2/2010 McDonough et al. ..... 315/291
7,683,504 B2 * 3/2010 Blair et al. ..... 307/141
7,994,732 B2 * 8/2011 Zulch ..... 315/291
2003/0057890 A1 3/2003 Lys et al.
2004/0150355 A1 8/2004 Tani et al.

FOREIGN PATENT DOCUMENTS

JP 2004235498 8/2004

OTHER PUBLICATIONS

Lutron Electronics Co., Inc. Lutron Specification Benefits. http://classic.lutron.com/CMS400/WorkArea/downloadasset.aspx?id=19853. Nov. 8, 2002.

* cited by examiner

*Primary Examiner* — Minh D A
(74) *Attorney, Agent, or Firm* — Van Pelt, Yi & James LLP

(57) ABSTRACT

A system for changing a light source intensity comprises a controller, an input interface, and a memory. The input interface is configured to receive a command intensity for a light source, wherein the light source has a current intensity, and wherein an intensity of the light source is ramped toward the command intensity from the current intensity automatically. The controller is configured to determine a non-linear curve for the intensity of the light source, wherein at least a portion of the non-linear curve includes a beginning slope that is steeper than an end slope and to cause a change of a light source intensity by ramping over a time interval, wherein the light source intensity targets conforming to the non-linear curve for the intensity of the light source. The memory is coupled to the processor and configured to store an intensity value.

21 Claims, 8 Drawing Sheets

INTENSITY CHANGING WITH REDUCED FLICKER FOR DIGITALLY-CONTROLLED LIGHTING

CROSS REFERENCE TO OTHER APPLICATIONS

This application is a continuation of U.S. patent application Ser. No. 11/809,364, entitled INTENSITY CHANGING WITH REDUCED FLICKER FOR DIGITALLY-CONTROLLED LIGHTING filed May 31, 2007 U.S. Pat. No. 7,994,732 which is incorporated herein by reference for all purposes, which claims priority to U.S. Provisional Application No. 60/856,560, entitled SMOOTH DIMMING OF LEDS filed Nov. 3, 2006 which is incorporated herein by reference for all purposes.

BACKGROUND OF THE INVENTION

Modern lighting control systems use digital commands to set light source intensity, where the numeric value of each command is an integer ranging from zero through a certain maximum and corresponds to 0 to 100% of the maximum intensity of the light source being controlled. It is often desirable to change the intensity at a metered rate to avoid abrupt transitions. This is accomplished by issuing a series of intensity commands at intervals to approximate the desired ramp. However under certain conditions the individual intensity step changes making up the ramp are visible, which is perceived by the human eye as an irritating flicker. When the light source responds quickly to commands, such as with LEDs (Light-Emitting Diodes), the flicker can be very pronounced. The human eye is relatively insensitive to absolute light levels, but extraordinarily sensitive to abrupt intensity changes. Even the smallest possible change is visible at low intensity levels because the numeric difference between commands is large relative to the value of the commands. For example, the USITT DMX lighting control protocol specifies that each intensity command utilize 8 bits, thus having a range of values from zero to 255. If the current intensity is 1 then changing to a new intensity of 2 represents doubling the brightness and will certainly be visible as an abrupt transition. A typical system today attempts to mitigate this effect by increasing the resolution, using for example 12 or 16 bits per command, but the flicker effect is still visible at lower intensities. Also, higher resolutions have a higher overhead due to the increase in handling the increased number of bits per command. It would be useful to change the intensity of a light source in response to digital commands regardless of intensity and command resolution without an observer being able to notice a flickering of the light source.

BRIEF DESCRIPTION OF THE DRAWINGS

Various embodiments of the invention are disclosed in the following detailed description and the accompanying drawings.

DETAILED DESCRIPTION

Figure 1:
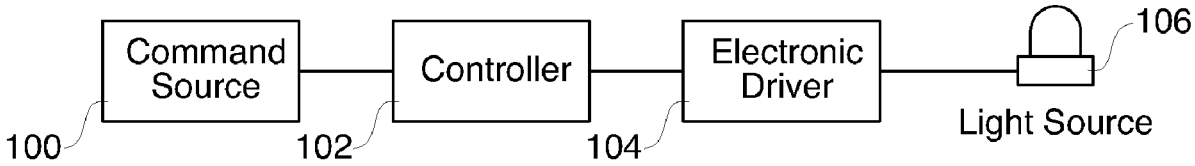
FIG. 1 is a block diagram illustrating an embodiment of a lighting system capable of a reduced flicker intensity change.

The invention can be implemented in numerous ways, including as a process, an apparatus, a system, a composition of matter, a computer readable medium such as a computer readable storage medium or a computer network wherein program instructions are sent over optical or communication links. In this specification, these implementations, or any other form that the invention may take, may be referred to as techniques. A component such as a processor or a memory described as being configured to perform a task includes both a general component that is temporarily configured to perform the task at a given time or a specific component that is manufactured to perform the task. In general, the order of the steps of disclosed processes may be altered within the scope of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Reduced flicker intensity changing for digitally-controlled lighting is disclosed. Digital commands from an external source specify desired light source intensities. Transitions between commanded intensities are performed with reduced flicker by setting the light source intensity to progressive intermediate values over time until the newly commanded value is reached. The intermediate intensity values and the time intervals between them are selected to minimize stepping visibility to the human eye, or flicker, by adjusting the intensity according to a non-linear curve. The non-linear curve includes an average slope of the ramp that is steepest at the beginning of the transition and reduced towards the end of the transition. In some embodiments, the shape of the non-linear curve can be adjusted by a command or a control panel. In some embodiments, the shape of the non-linear curve can be set to approximate the response time of a different light source. If a new command is received before the light source has reached the previously-commanded intensity, the previous command is abandoned and the light source is adjusted from its current intensity to the newly-commanded intensity. In some embodiments, an indication is transmitted back to the external command source when the transition is complete. Reduction of flicker may be disabled for sequential changes to command intensity which are larger than a threshold, allowing the light source to turn on or off quickly when desired. Reduction of flicker can also be enabled or disabled by means of an external command or switch.

FIG. 1 is a block diagram illustrating an embodiment of a lighting system capable of a reduced flicker intensity change. In the example shown, Command Source 100 issues digital commands for desired intensities to Controller 102, which is capable of using Electronic Driver 104 to set intensity for Light Source 106 in the range of 0 to 100% of its maximum.

In some embodiments, command source 100 comprises a lighting control panel that includes one or more controls (e.g., switches, slides, dimmers, value selectors, etc.) for setting the intensities of one or more lights. In some embodiments, command source 100 comprises a computer system including software that creates a virtual lighting control panel that enables one or more virtual controls (e.g., virtual switches, virtual slides, virtual dimmers, virtual value selectors, etc.) for setting the intensities of one or more lights. In some embodiments, command source 100 comprises a computer system with a pre-programmed set of commands that are output to a controller such as controller 102. In some embodiments, command source 100 comprises a human interface device. In some embodiments, command source 100 provides commands via a data interface.

In some embodiments, controller 102 is a processor that calculates one or more intensity step values and times corresponding to when the step values are to be taken to achieve a reduced flicker intensity change for light source 106. In some embodiments, controller 102 uses look up tables to determine intensity step values and times corresponding to when the step values are to be taken. In some embodiments, the look up table entry that is relevant for determining the intensity step value change and the step times depends on the current intensity value and the target intensity value.

In some embodiments, controller 104 is a pulse width modulated current source that is used to drive light source 106, where light source 106 is a light emitting diode (LED). In some embodiments, the current source is a constant current source In various embodiments, light source 106 comprises a single LED, multiple LED's, is driven by a single controller unit or multiple controller units, or any other appropriate controller/light source configuration. In various embodiments, light source 106 comprises an incandescent lamp, a florescent lamp, a high intensity discharge lamp, or any other light source technologies in any combination.

Figure 2A:
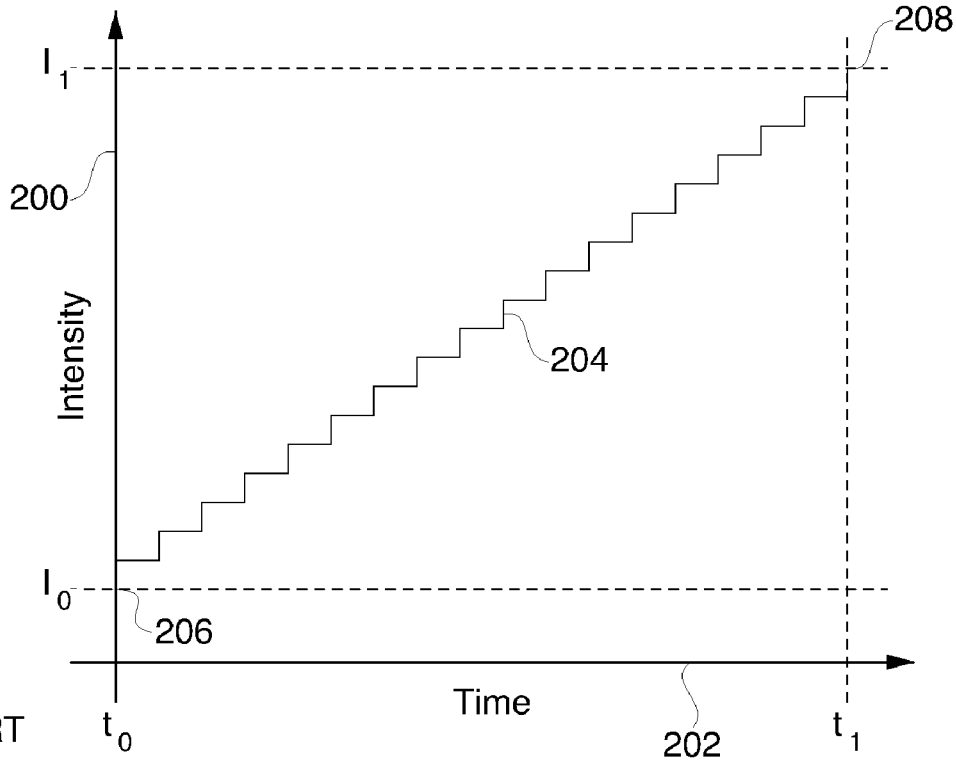
Fig. 2A PRIOR ART
FIG. 2A is a graph illustrating an embodiment of a low-resolution linear transition ramp as seen in the prior art.

FIG. 2A is a graph illustrating an embodiment of a low-resolution linear transition ramp as seen in the prior art. In the example shown, vertical axis 200 shows light source intensity and horizontal axis 202 corresponds to time. Ramp 204 consists of roughly uniform steps starting at point 206 corresponding to previous intensity $I_0$ at starting time $t_0$, and ending at point 208 corresponding to newly-commanded intensity $I_1$ at ending time $t_1$. These steps include steps in intensity that are visible as flicker, particularly at low intensity levels.

Figure 2B:
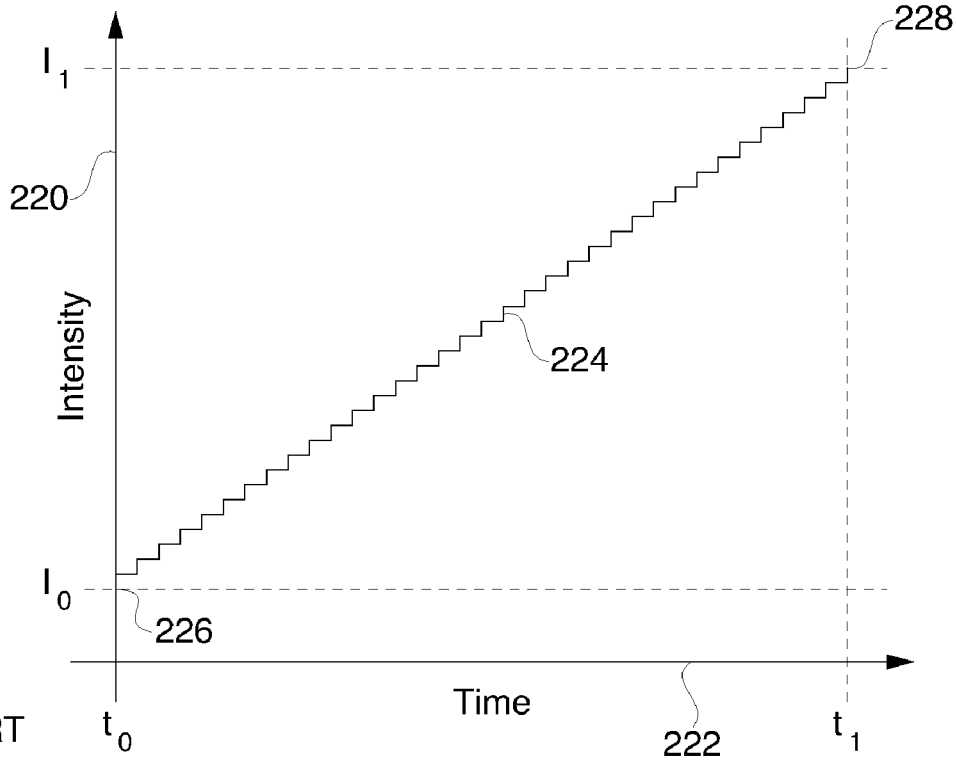
Fig. 2B PRIOR ART
FIG. 2B is a graph illustrating an embodiment of a high-resolution linear transition ramp as sometimes used in the prior art in an attempt to reduce flicker.

FIG. 2B is a graph illustrating an embodiment of a high-resolution linear transition ramp as sometimes used in the prior art in an attempt to reduce flicker. In the example shown, vertical axis 220 shows light source intensity and horizontal axis 222 corresponds to time. Ramp 224 consists of roughly uniform steps starting at point 226 corresponding to previous intensity $I_0$ at starting time $t_0$, and ending at point 228 corresponding to newly-commanded intensity $I_1$ at ending time $t_1$. While these the steps are more subtle than those of the low-resolution ramp 204 in FIG. 2A, it can be seen that the ramps have the same shape. Further, the intensity steps include steps in intensity that are visible as flicker, particularly at low intensity levels similar to the situation as depicted in FIG. 2A. Note that many more intensity commands must be issued to generate the high-resolution ramp. One problem that arises is that the maximum rate of intensity commands supported by the physical hardware can constrain the maximum resolution. For example, the ramp may have to skip over some of the intermediate values in order to reach the final intensity within the desired amount of time.

Figure 3A:
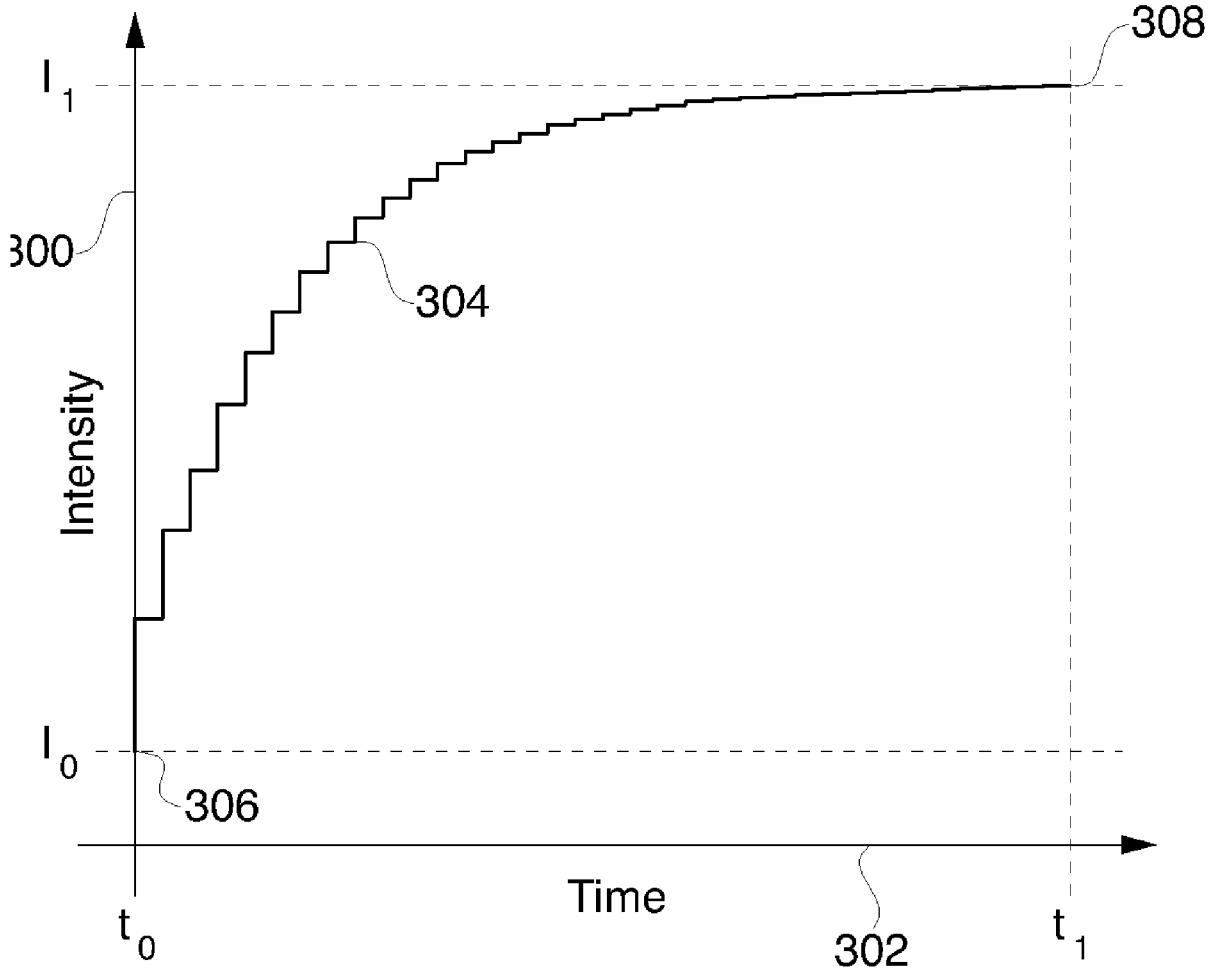
FIG. 3A is a graph illustrating an embodiment of a non-linear transition ramp between two intensities.

FIG. 3A is a graph illustrating an embodiment of a non-linear transition ramp between two intensities. In the example shown, the intensity is changed at high resolution using constant time intervals between steps. Vertical axis 300 shows light source intensity and horizontal axis 302 corresponds to time. Ramp 304 consists of steps with decreasing height starting at point 306 corresponding to previous intensity $I_0$ at starting time $t_0$, and ending at point 308 corresponding to newly-commanded intensity $I_1$ at ending time $t_1$. Because the steps get smaller as the transition proceeds the human eye perceives a reduced flicker during the intensity change.

In some embodiments, the steps with decreasing height are determined using pre-calculated values, where the pre-calculated values depend on the previous intensity $I_0$ and the newly-commanded intensity $I_1$. In some embodiments, a second new intensity is received before the first new intensity, the newly-commanded intensity $I_1$, is reached. In this case, the second new intensity becomes the target intensity (e.g., intensity $I_1$) and the current intensity becomes the starting intensity (e.g., intensity $I_0$). In various embodiments, the time interval between the steps is a predetermined value, a number of different values, a set of increasing or decreasing values, or any other appropriate time interval for reducing flicker. In various embodiments, the intensity step values and the time intervals at which the steps occur are selected to follow a predetermined pattern, where the predetermined pattern appears to be visually similar to a type of incandescent lamp, a theater lamp, a strobe lamp, a spot lamp, or any other appropriate lamp type. In various embodiments, the predetermined patterns are selected using a human interface device (e.g., a control panel, a switch, a graphical user interface, etc.), a command via a data interface (e.g., a digital interface, an analog interface, a fiber optic interface, an electrical interface, a wireless interface, a wired interface, an infrared interface, etc.).

Figure 3B:
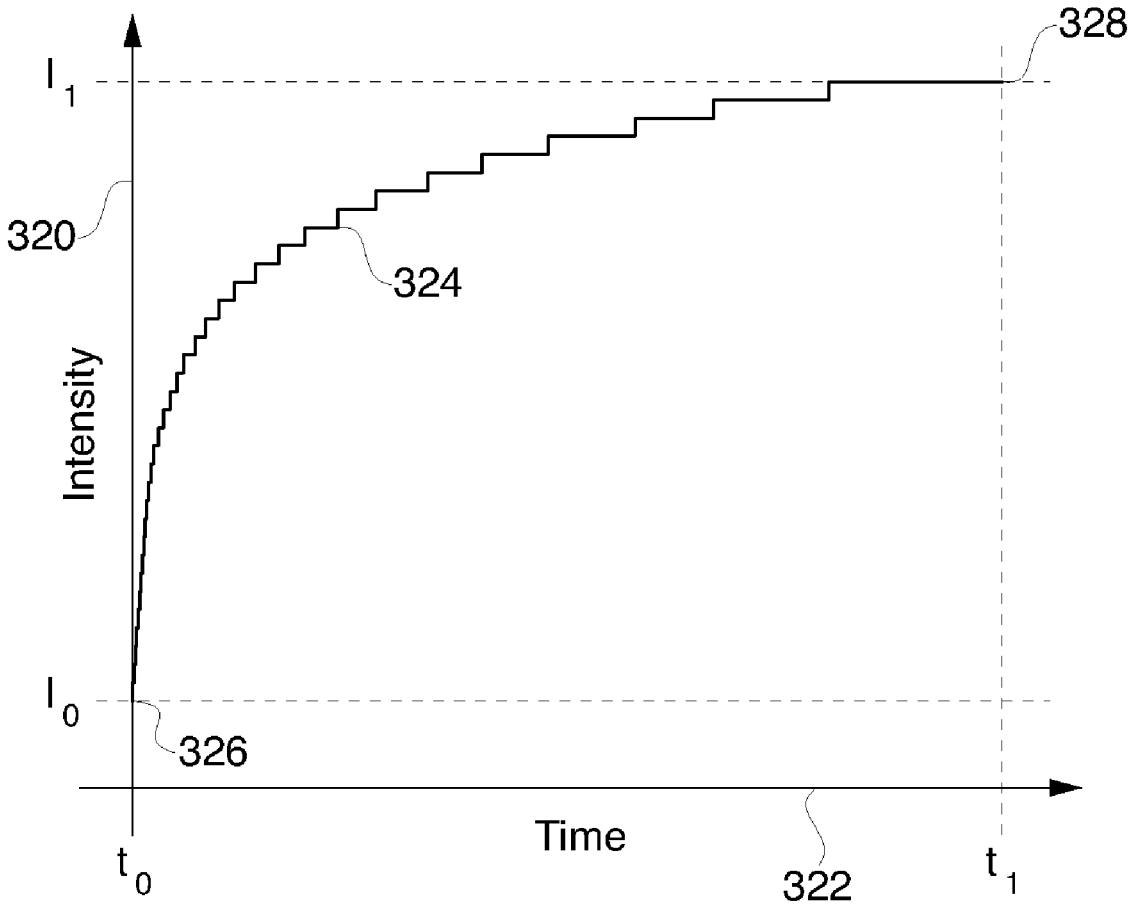
FIG. 3B is a graph illustrating an embodiment of a non-linear transition ramp between two intensities.

FIG. 3B is a graph illustrating an embodiment of a non-linear transition ramp between two intensities. In the example shown, the intensity is changed by constant increments at low resolution using variable time intervals between steps. Vertical axis 320 shows light source intensity and horizontal axis 322 corresponds to time. Ramp 324 consists of steps with increasing width starting at point 326 corresponding to previous intensity $I_0$ at starting time $t_0$, and ending at point 328 corresponding to newly-commanded intensity $I_1$ at ending time $t_1$. Comparing ramp 324 near point 328 in FIG. 3B to ramp 304 near point 308 in FIG. 3A, it can be seen that the vertical increments are larger and the time intervals grow longer towards the end of the ramp. Both ramps of FIGS. 3A and 3B describe transitions that appear to have reduced flicker as compared to the linear ramps of FIGS. 2A and 2B. Note that ramp 304 of FIG. 3A requires higher resolution intensity control than ramp 324 of FIG. 3B. In some embodiments, because lower resolutions are generally easier to calculate than higher resolutions, a less expensive controller can be used with the lower resolution required by FIG. 3B as compared with the higher resolution required by FIG. 3A.

Figure 3C:
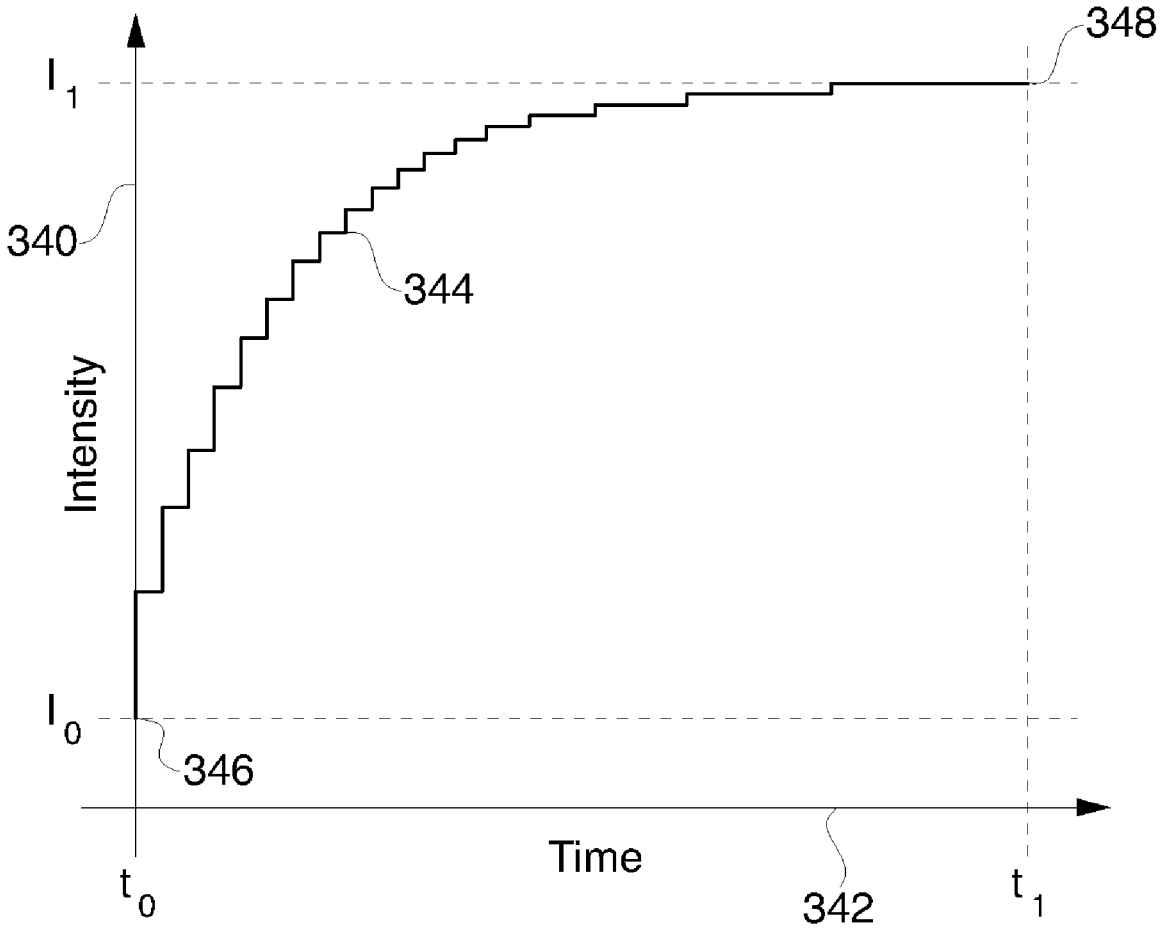
FIG. 3C is a graph illustrating an embodiment of a non-linear transition ramp between two intensities.

FIG. 3C is a graph illustrating an embodiment of a non-linear transition ramp between two intensities. In the example shown, the intensity is changed by variable increments using variable time intervals between steps. Vertical axis 340 shows light source intensity and horizontal axis 342 corresponds to time. Ramp 344 consists of steps with both decreasing height and increasing width starting at point 346 corresponding to previous intensity $I_0$ at starting time $t_0$, and ending at point 348 corresponding to newly-commanded intensity $I_1$ at ending time $t_1$. Comparing ramp 344 in FIG. 3C to ramp 304 in FIG. 3A and ramp 324 in FIG. 3B, it can be seen that the resolution along both intensity and time axis is reduced. All ramps of FIGS. 3A, 3B, and 3C describe transitions that appear to have reduced flicker as compared to the linear ramps of FIGS. 2A and 2B. In some embodiments, changing both height and width for each step creates transitions that appear to have further reduced flicker as compared to step changes that occur only on one axis. In some embodiments, changing both height and width for each step permits the use of lower intensity resolutions and lower time resolutions for a given degree of reduced flicker. In some embodiments, because lower resolutions are generally easier to calculate than higher resolutions, a less expensive controller can be used with the lower resolution required by FIG. 3C as compared with the higher intensity resolution required by FIG. 3A or the higher time resolution required by FIG. 3B.

Figure 4:
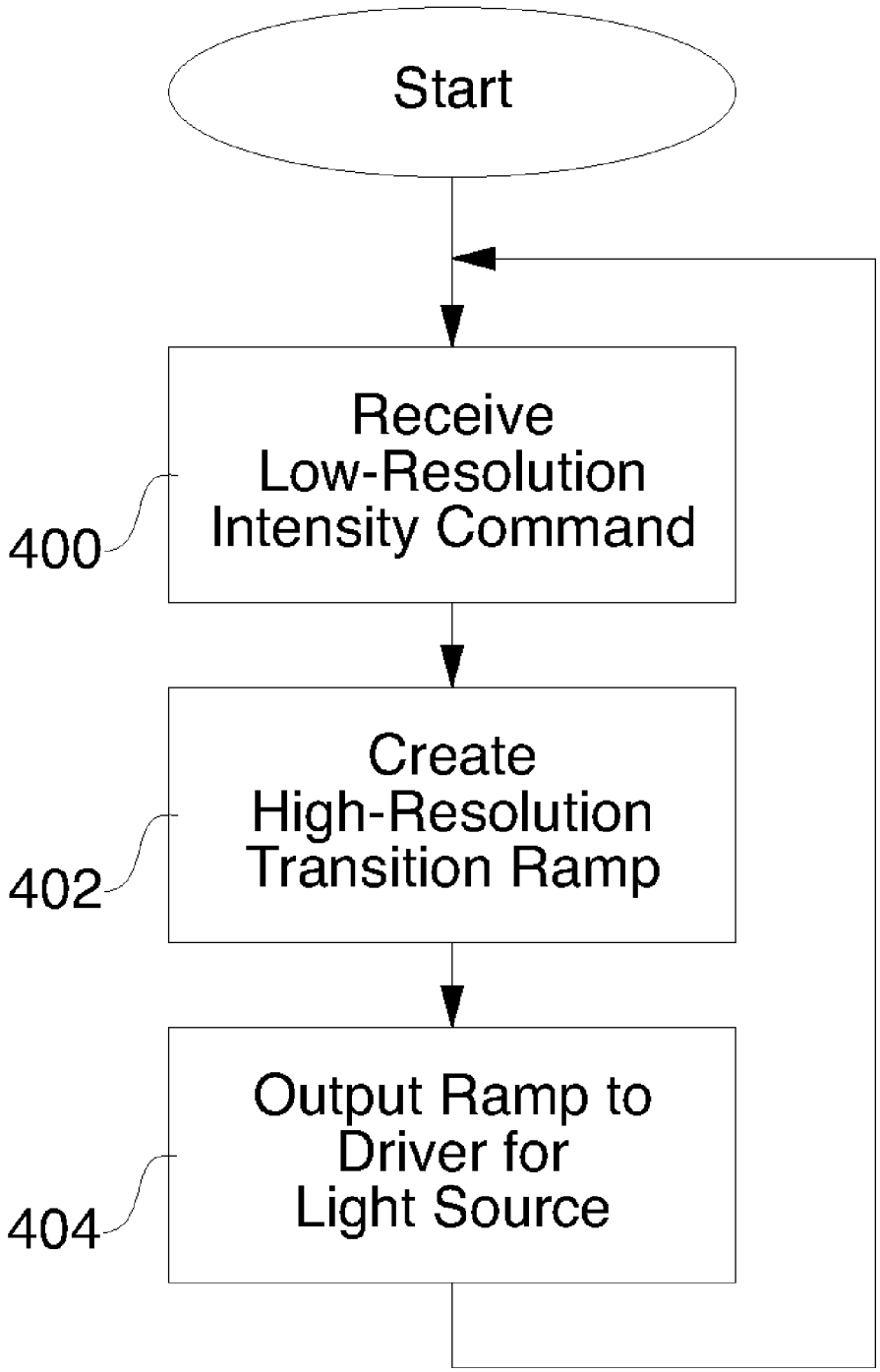
FIG. 4 is a flow chart illustrating an embodiment of a process for controlling an intensity change.

FIG. 4 is a flow chart illustrating an embodiment of a process for controlling an intensity change. In some embodiments, the process of FIG. 4 is executed by controller showing an overview of Controller operation. In the example shown, in 400 a new intensity command is received. In some embodiments, the command is received from a lighting control panel or computer that includes a control panel in software for lighting. In 402, a non-linear transition ramp between the current light source intensity and the newly-commanded intensity is created. In various embodiments, the ramp is created using a table, a mathematical formula, a piece-wise linear approximation for a curve, or any other appropriate manner of creating a ramp. In 404, the ramp is output to the electronics driver. The driver drives the light source (e.g., an LED light source) to change the intensity of the light source. Control passes back to 400. In some embodiments, the process completes when a command is received to shut down. In some embodiments, the transition ramp will be generated in parallel with outputting it to the driver; for example, one or more of the steps within the ramp will be computed and output to the driver before the steps for the entire ramp is calculated. In some embodiments this output step will be terminated early if a new intensity command is available.

Figure 5:
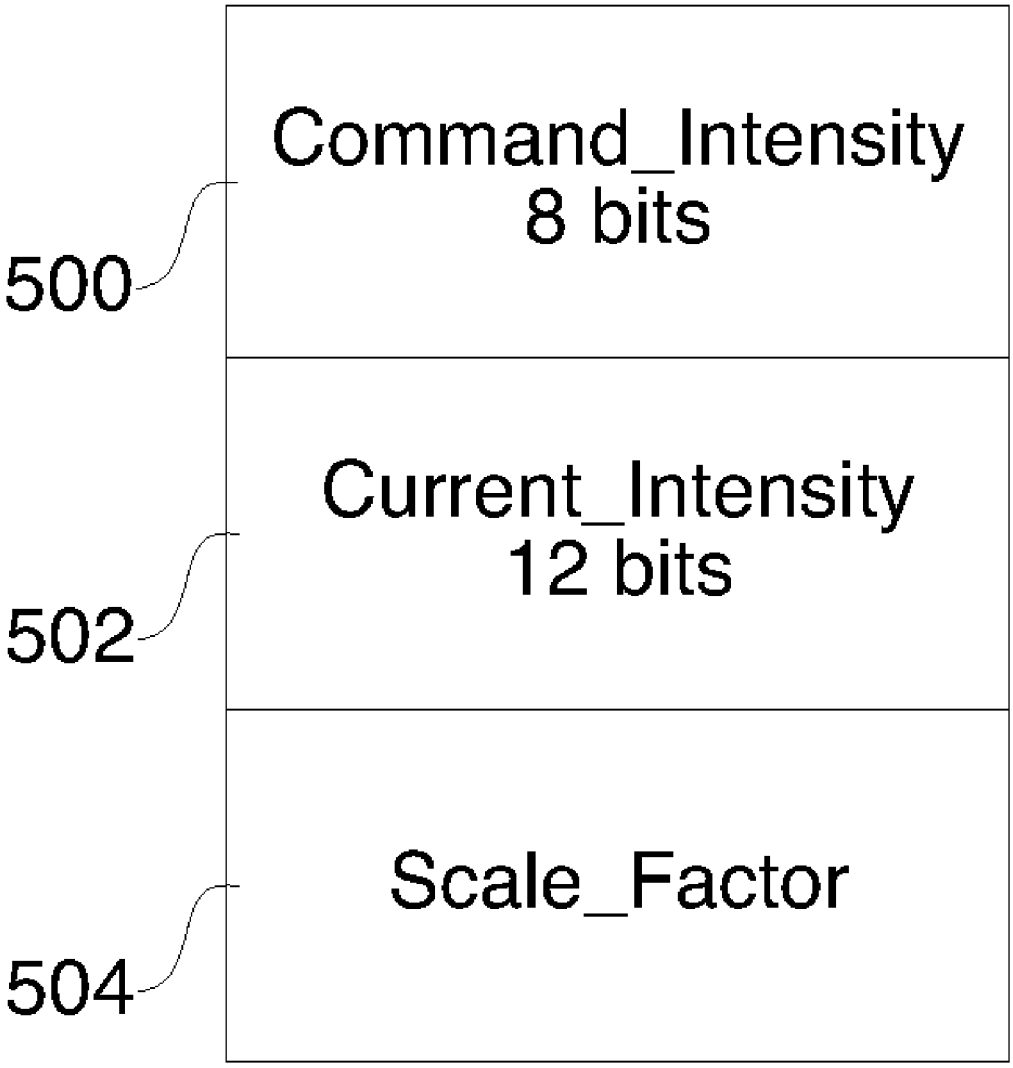
FIG. 5 is a block diagram illustrating an embodiment of state data that is maintained by the Controller.

FIG. 5 is a block diagram illustrating an embodiment of state data that is maintained by the Controller. In some embodiments, the state data of FIG. 5 is used by a controller such as controller 102 of FIG. 1 in conjunction with determining a control signal (e.g., a ramp of steps) for a light source (e.g., a LED). In the example shown, Command_Intensity 500 stores the last received intensity command using an 8 bit value. In some embodiments, a Command_Intensity is stored using a different number of bits as appropriate for the light controlling system. Current_Intensity 502 stores the intensity most recently output to the driver using 12 bits, and represents one of the intermediate values in the non-linear ramp. In some embodiments, the number of bits used to store Current_Intensity is selected to allow the transition ramp to be of a higher resolution than the resolution of the command intensity. Scale_Factor 504 affects the shape of the non-linear ramp. The time required for the ramp to change the intensity from the current intensity to the command intensity will depend on Scale_Factor 504. In some embodiments, Scale_Factor 504 is a constant. In some embodiments, Scale_Factor 504 can be changed dynamically by a command as indicated using a switch or otherwise on a physical or software control panel or from another command source to change the shape of the non-linear ramp. The shape of the non-linear ramp can range from very slow and smooth, to moderately fast and more abrupt, to an immediate transition to the Command_Intensity.

In some embodiments, a new command intensity is received that causes an immediate (e.g., strobe is selected) light source intensity change to the new command intensity. In some embodiments, if the magnitude of the difference between the new command intensity and the current intensity exceeds a threshold, then the intensity change is set to take place without a ramp (e.g., strobe is selected).

Figure 6:
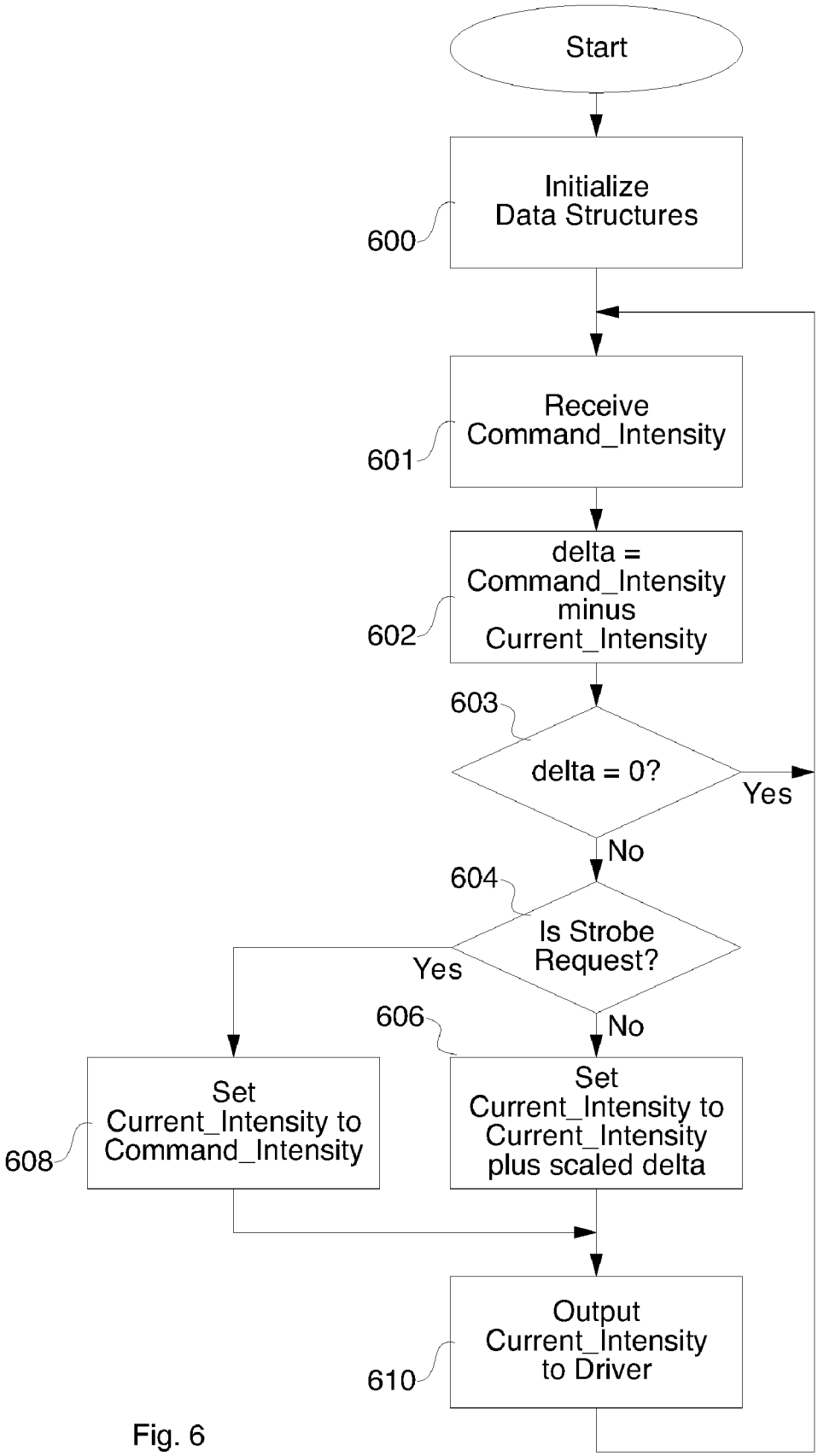
FIG. 6 is a flow chart illustrating an embodiment of detailed Controller operation.

FIG. 6 is a flow chart illustrating an embodiment of a process for controlling an intensity change. In the example shown, in 600 data structures are initialized. In some embodiments, the data structures include the state variables of FIG. 5. In the example shown, in 601 a new intensity command is received. In some embodiments, the command is received from a lighting control panel or computer that includes a control panel in software for lighting. In 602, the difference (i.e., delta) between the current actual intensity of the light source and the desired value most recently commanded is calculated. In 603, it is determined if the delta is zero. In some embodiments, delta is determined to be zero when the current intensity is substantially equal to the command intensity. If delta is zero, then control passes to 601. If delta is not zero, then in 604 it is determined if strobe is selected. If strobe is selected, then in 608 Current_Intensity is set to Command_Intensity. Selecting strobe indicates a sudden change in intensity. If strobe is not selected, in 606 scale delta and set Current_Intensity to Current_Intensity plus scaled delta. In some embodiments, delta is scaled using a scale factor in the data structure (e.g., Scale_Factor 504 of FIG. 5). In some embodiments, the scaled value is adjusted to be never less than one. In 610, Current_Intensity is output to the light source driver and control passes to 601. Since the first delta of a transition ramp is the largest for that ramp, the first intermediate step calculated by scaling will also be the largest. Subsequent differences will be progressively smaller as will the corresponding intensity steps until the ramp is complete. These decreasing differences result in the desired non-linear ramp.

In some embodiments, the intensity step remains constant and the time interval between intensity changes is scaled to grow longer with each step.

In some embodiments, the intensity and time steps are scaled or changed in setting the ramp to a command intensity from a current intensity.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system for changing light source intensity, comprising:

an input interface to:

receive a command intensity for a light source, wherein the light source has a current intensity, and wherein an intensity of the light source is ramped toward the command intensity from the current intensity automatically; and a controller configured to:

determine a non-linear curve for the intensity of the light source, wherein the non-linear curve is based at least in part on the command intensity and the light source intensity, and wherein at least a portion of the non-linear curve includes a beginning slope that is steeper than an end slope of the non-linear curve; and cause a change of a light source intensity by ramping over a time interval, wherein the light source intensity targets conforming to the non-linear curve for the intensity of the light source, and wherein beginning causing the change of the light source intensity starts before completion of determining the non-linear curve for the intensity of the light source; and a memory coupled to the controller and configured to store an intensity value.

2. The system as in claim 1, wherein determining the non-linear curve for the intensity of the light source includes using a command time interval between the command intensity and a subsequent command intensity.

3. The system as in claim 1, wherein the input interface is further configured to receive a new command intensity before the light source intensity has become equal to the command intensity and replacing the command intensity with the new command intensity with the new command intensity, and wherein the controller is further configured to determine a new non-linear curve for the intensity of the light source.

4. The system as in claim 1, wherein the time interval is based at least in part on one or more of the following: a) the command intensity, b) the light source intensity, and c) the time interval between the command intensity and a subsequent command intensity.

5. The system as in claim 1, wherein the command intensity is greater than the light source intensity.

6. The system as in claim 1, wherein the non-linear curve and the time interval are selected so that the change of the light source intensity follows one of a plurality of predetermined patterns.

7. The system as in claim 6, wherein the one of the plurality of predetermined patterns is constructed to appear visually similar to a change in intensity of a type of incandescent lamp.

8. The system as in claim 6, wherein the one of the plurality of predetermined patterns is selected using a human interface device.

9. The system as in claim 6, wherein the one of the plurality of predetermined patterns is selected using a command via a data interface.

10. The system as in claim 1, wherein the controller is further configured to send an indication that the light source intensity has become substantially equal to the command intensity.

11. The system as in claim 1, wherein the input interface is further configured to receive a new command intensity, and wherein the controller is further configured to cause a quick change in the light source intensity in the event that the magnitude of a difference between the new command intensity and the command intensity exceeds a threshold.

12. The system as in claim 1, wherein the input interface is further configured to receive a second command intensity, wherein the controller is further configured to determine the non-linear curve in intensity for the light source includes using the command intensity and the second command intensity.

13. The system as in claim 1, wherein the light source intensity is associated with an intensity resolution, wherein the command intensity is associated with a command resolution, and wherein the intensity resolution is higher than the command resolution.

14. The system as in claim 1, wherein the non-linear curve is selected so that the time interval targets a selected time interval.

15. A computer program product for changing light source intensity, the computer program product being embodied in a computer and comprising computer instructions for:

receiving a command intensity for a light source, wherein the light source has a current intensity, and wherein an intensity of the light source is ramped toward the command intensity from the current intensity automatically;

determining a non-linear curve for the intensity of the light source, wherein the non-linear curve is based at least in part on the command intensity and the light source intensity, and wherein at least a portion of the non-linear curve includes a beginning slope that is steeper than an end slope of the non-linear curve; and causing a change of a light source intensity by ramping over a time interval, wherein the light source intensity targets conforming to the non-linear curve for the intensity of the light source, and wherein beginning causing the change of the light source intensity starts before completion of determining the non-linear curve for the intensity of the light source.

16. A method for changing light source intensity, comprising:

receiving a command intensity for a light source, wherein the light source has a current intensity, and wherein an intensity of the light source is ramped toward the command intensity from the current intensity automatically;

determining a non-linear curve for the intensity of the light source, wherein the non-linear curve is based at least in part on the command intensity and the light source intensity, and wherein at least a portion of the non-linear curve includes a beginning slope that is steeper than an end slope of the non-linear curve; and causing a change of a light source intensity by ramping over a time interval, wherein the light source intensity targets conforming to the non-linear curve for the intensity of the light source, and wherein beginning causing the change of the light source intensity starts before completion of determining the non-linear curve for the intensity of the light source.

17. A system for changing light source intensity, comprising:

an input interface to:

receive a command intensity for a light source, wherein the light source has a current intensity, and wherein an intensity of the light source is ramped toward the command intensity from the current intensity automatically; and a controller configured to:

determine a non-linear curve for the intensity of the light source, wherein at least a rising portion of the non-linear curve includes a beginning slope that is steeper than an end slope of the portion of the non-linear curve;

cause a change of a light source intensity by ramping over a time interval, wherein the light source intensity targets conforming to the non-linear curve for the intensity of the light source, and wherein beginning causing the change of the light source intensity starts before completion of determining the non-linear curve for the intensity of the light source; and a memory coupled to the controller and configured to store an intensity value.

18. The system as in claim 17, wherein determining the non-linear curve for the intensity of the light source includes using one or more of the following: a) the command intensity, b) the light source intensity, and c) the time interval between the command intensity and a subsequent command intensity.

19. The system as in claim 17, wherein the input interface is further configured to receive a new command intensity before the light source intensity has become equal to the command intensity, and wherein the controller is further configured to determine a new non-linear curve for the intensity of the light source.

20. The system as in claim 17, wherein the time interval is based at least in part on one or more of the following: a) the command intensity, b) the light source intensity, and c) the time interval between the command intensity and a subsequent command intensity.

21. The system as in claim 17, wherein the input interface is further configured to receive a new command intensity, and wherein the controller is further configured to cause a quick change in the light intensity in the event that the magnitude of a difference between the new command intensity and the command intensity exceeds a threshold.

* * * * *